United States Patent [19]

Morgante et al.

[11] Patent Number: 4,829,917

[45] Date of Patent: May 16, 1989

[54] CONTROL SYSTEM FOR HYDRAULIC NEEDLE BAR POSITIONING APPARATUS FOR A TUFTING MACHINE

[75] Inventors: Michael R. Morgante, Buffalo; Greogory J. Guzewich; Henry J. Kowal, both of West Seneca; Christopher La Mendola, Kenmore, all of N.Y.; Randall E. Stanfield, Hixson, Tenn.

[73] Assignee: Tuftco Corporation, Chattanooga, Tenn.

[21] Appl. No.: 226,222

[22] Filed: Jul. 29, 1988

[51] Int. Cl.[4] ..... D05C 15/30

[52] U.S. Cl. ..... 112/80.41

[58] Field of Search ..... 112/80.41

[56] References Cited

U.S. PATENT DOCUMENTS

| | | | |
|---|---|---|---|
| 4,173,192 | 11/1979 | Schmidt | 112/80.41 |
| 4,366,761 | 1/1983 | Card | 112/80.41 |
| 4,483,260 | 11/1984 | Gallant | 112/80.41 |

*Primary Examiner*—Ronald Feldbaum

*Attorney, Agent, or Firm*—Harrington A. Lackey

[57] ABSTRACT

An electronic computer control for a hydraulic actuator for shifting a needle bar to different transverse positions in a tufting machine. The computer control directs the hydraulic actuator to be driven in response to the predetermined stitch pattern information in the computer control circuit, which determines the amount of relative tansverse shifting of the needle bar for each stitch location, in such a manner that the needle bar is shifted transversely only a needle gauge, or a multiple needle gauge, at a time and only while the needles are out of the backing fabric. The computer control also controls the velocity of the transverse movement of the needle bar in a gradual manner to minimize any shock created by the transverse movement of the needle bar upon the tufting machine. In order to enhance the smooth and gradual shifting movement of the needle bar, the computer control command signals commence prior to the actual commencement of needle bar shifting and terminate prior to the re-entry of the needles into the backing fabric to counteract any delayed inertial movement of the needle bar in response to the computer command signals.

13 Claims, 4 Drawing Sheets

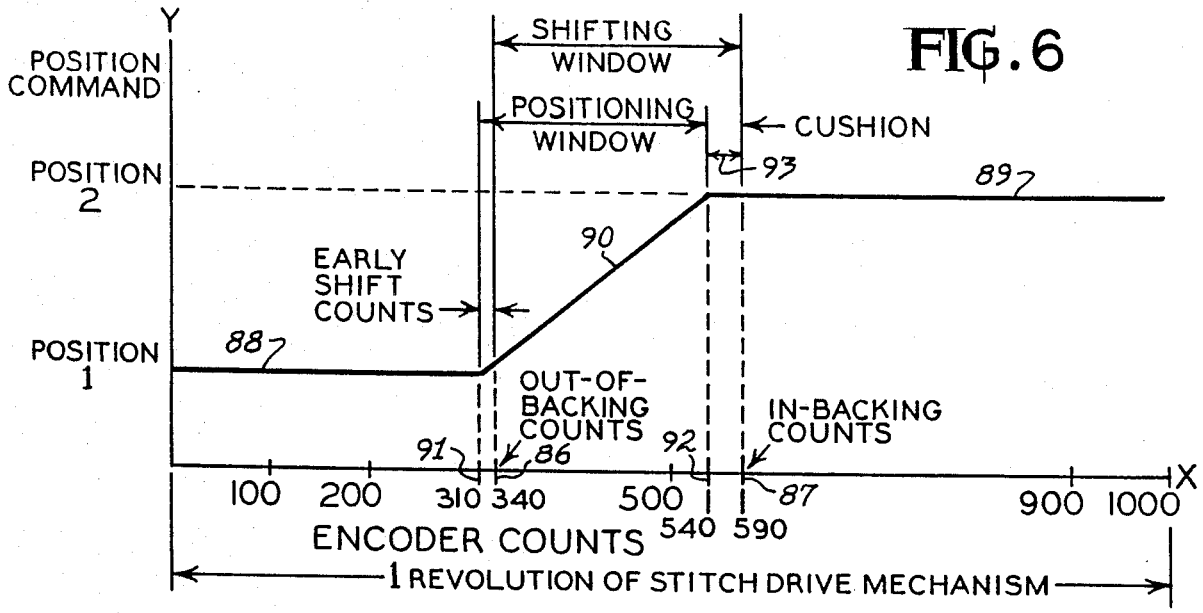
FIG. 6
Y
POSITION COMMAND
POSITION 2
POSITION 1
SHIFTING WINDOW
POSITIONING WINDOW
CUSHION
93
89
90
EARLY SHIFT COUNTS
88
OUT-OF-BACKING COUNTS
IN-BACKING COUNTS
91
86
92
87
X
100
200
310
340
500
540
590
900
1000
ENCODER COUNTS
1 REVOLUTION OF STITCH DRIVE MECHANISM

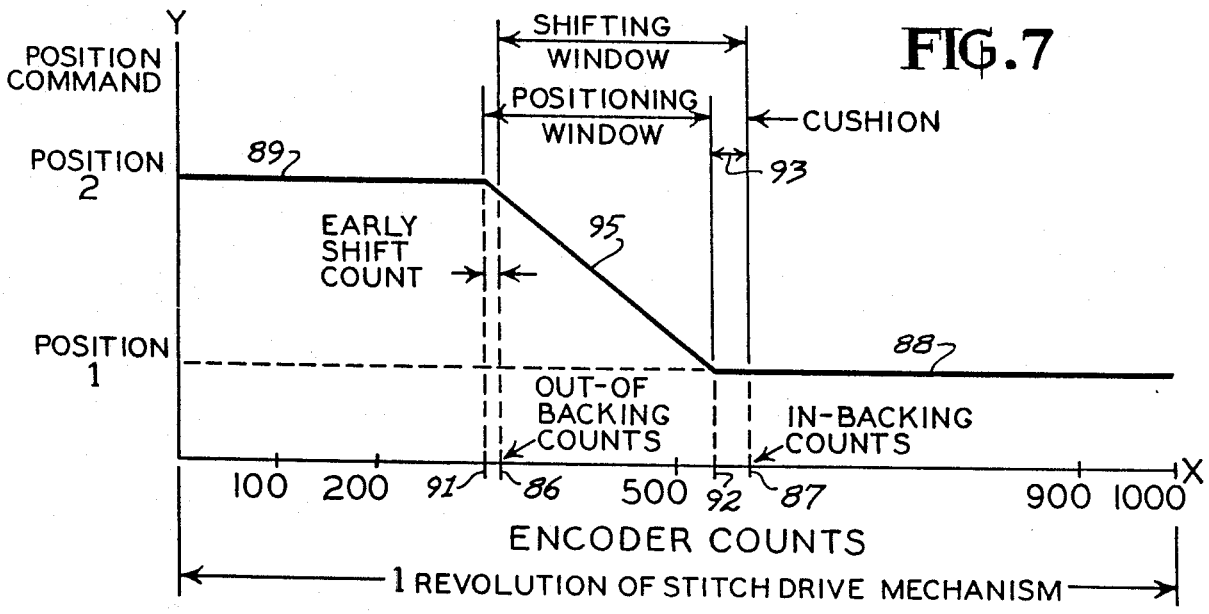
FIG. 7
Y
POSITION COMMAND
POSITION 2
POSITION 1
SHIFTING WINDOW
POSITIONING WINDOW
CUSHION
93
89
95
EARLY SHIFT COUNT
88
OUT-OF BACKING COUNTS
IN-BACKING COUNTS
100
200
91
86
500
92
87
900
1000
X
ENCODER COUNTS
1 REVOLUTION OF STITCH DRIVE MECHANISM

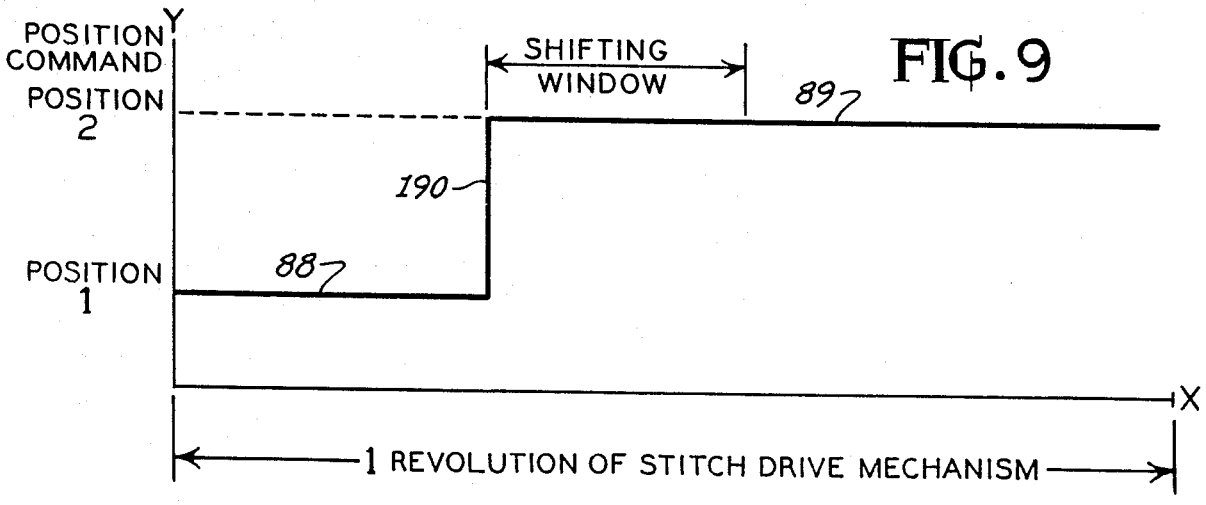
FIG. 9
Y
POSITION COMMAND
POSITION 2
POSITION 1
SHIFTING WINDOW
89
190
88
X
1 REVOLUTION OF STITCH DRIVE MECHANISM

CONTROL SYSTEM FOR HYDRAULIC NEEDLE BAR POSITIONING APPARATUS FOR A TUFTING MACHINE

BACKGROUND OF THE INVENTION

This invention relates to a hydraulic needle bar positioning apparatus for a multiple needle tufting machine, and more particularly to a computer control system for a hydraulic needle bar positioning apparatus for a multiple needle tufting machine.

Heretofore in the production of tufted fabrics, distinctive patterns, such as various zig-zag patterns have been formed in backing fabrics by transversely or laterally shifting the needle bar, or by shifting the backing material support beneath the needles, needle-gauge increments for each stitch, in accordance with a predetermined pattern.

One means for executing this lateral or transverse shifting of the needle bar, or the backing material support, is a pattern cam continuously rotated in synchronism with the rotary drive of the tufting machine, in which the pattern cam engages a movable needle bar, or a laterally reciprocably movable backing material support. Examples of such pattern cam control mechanisms for laterally shiftable needle bars or fabric supports are disclosed in numerous prior U.S. patents, such as the following:

| | | |
|---|---|---|
| 2,513,261 | Behrens | June 27, 1950 |
| 2,679,218 | Jones | May 25, 1954 |
| 2,682,841 | McCutchen | July 6, 1954 |
| 2,855,879 | Manning et al | Oct. 14, 1958 |
| 3,026,830 | Bryant et al | Mar. 27, 1962 |
| 3,100,465 | Broaderick | Aug. 13, 1963 |
| 3,109,395 | Batty et al | Nov. 5, 1963 |
| 3,396,687 | Nowicki | Aug. 13, 1968 |

There are numerous disadvantages in the use of pattern cams for controlling the lateral or transverse shifting of needle bars or fabric supports.

Since the pattern cam control mechanism is entirely mechanical, there is considerable wear on both the cam surfaces and the cam rollers or followers.

There is a long change-over period for the pattern cams, when patterns of different designs are required.

Machine speed is limited by, not only the mechanical arrangement, but also the abrupt changes in the pattern cam surfaces.

There is extremely high machine stress caused by having no accelerate the lateral movement of the needle bar to near infinity because of the sharp cam lobes.

Where there are machining inaccuracies in the profile of the cams, differing lateral or transverse relationships between the hooks and needles may be produced for different pattern positions.

The continuous operation of the pattern cams and cam followers produces an excessive noise level.

The common assignee's prior U.S. Pat. No. 4,173,192 discloses an electrohydraulic needle bar positioning apparatus including a hydraulic actuator coupled to the needle bar and controlled by an electronic control circuit including a PROM (Programmable Read Only Memory) for deter mining the stitch pattern of the tufting machine.

Although the electrohydraulic needle bar positioner of the prior U.S. Pat. No. 4,173,192, overcame many of the disadvantages of a cam-controlled needle bar positioner or shifter, nevertheless, the electronic controls for the previous electrohydraulic needle bar positioner produced an instantaneous command change to the hydraulic actuator calling for instantaneous maximum speed of the transversely moving needle bar independent of the tufting machine's main motor speed. Such abrupt speed changes caused excessive shock loads to the machinery which in turn limited the machine life.

SUMMARY OF THE INVENTION

It is therefore an object of this invention to provide improved controls for a hydraulic actuator for a needle bar positioning apparatus for a multiple needle tufting machine, will minimize the abrupt transverse movements of the needle bar and substantially reduce the shock loads imparted to the tufting machine.

Another object of this invention is to provide an electronic computer control system for synchronizing the needle bar positioning closely with the main shaft speed or stitch rate of the tufting machine in order to reduce the shock load on the machine.

Another object of this invention is to provide a computer control system for an electrohydraulic needle bar positioning apparatus which will gradually increase the velocity of the transversely moving needle bar at the commencement of the needle bar movement and gradually decrease the velocity of the needle bar at the termination of the needle bar movement.

The electrohydraulic positioning apparatus includes a hydraulic actuator coupled to the needle bar for transversely shifting or positioning the needle bar. The actuator is provided with a feedback transducer for monitoring the transverse position of the actuator at any current time. Both the actuator and the transducer are in electrical communication with a computer control unit, preferably in the form of a microprocessor. The microprocessor also receives input signals from an encoder which generates a plurality of encoder counts or signals for each revolution of the main shaft of the tufting machine, and hence for each stitch of the needles. The microprocessor control unit is programmed to produce a desired stitch pattern in which the needle bar is shifted in needle-gauge increments transversely in either direction and only while the needles are above the backing fabric. Moreover, the programmed pattern information within the microprocessor produces a position command signal, which changes linearly with the encoder counts only during that portion of the stitch cycle in which the needles are above the backing fabric. Moreover, the pattern command signals are generated to accommodate the inertia of the rapidly and transversely reciprocating needle bar as the needle bar moves from one needle gauge stitch position to another. Specifically, the command signal to shift the needle bar commences slightly before the needles rise out of the backing fabric or material and terminates before the needles re-enter or penetrate the backing fabric.

The microprocessor control unit is also designed to compare digital position command signals with digital information from feedback signals generated by the feedback transducer on the hydraulic actuator corresponding to the current position of the actuator, in order to produce a resultant drive signal which energizes the servovalve of the hydraulic actuator.

The electrohydraulic needle bar positioning apparatus made in accordance with this invention has practically no wearing parts and is therefore capable of substantially longer life and longer continual operational time than the prior art cam-controlled positioning devices.

The stitch patterns may be introduced into the microprocessor by manual I/O operator terminals, or by PROMS, similar to those utilized in the positioning apparatus disclosed in the above U.S. Pat. No. 4,173,192.

The positioning apparatus made in accordance with this invention provides accurate needle positioning information without the necessity of accurate machining of mechanical parts, and also permits repeat patterns having a substantially greater number of stitches than in prior needle bar shifting apparatus and particularly in those which are cam-controlled.

This positioning apparatus is a "closed loop system" which provides constant feedback information designating the exact position of the needles at all times, for greater control of the needle bar shifting movements.

Greater operating speeds of the tufting machine at low noise levels and with a minimum of abrupt shocks to the machine are possible with the positioning apparatus incorporating the computer control system of this invention.

BRIEF DESCRIPTION OF THE DRAWINGS

FIG. 6 is a graph of the linear relationship between the position command signals and the encoder counts generated by the control system for movement of the needle bar between first and second positions;

FIG. 7 is a graph similar to that of FIG. 6, but illustrating the position command signal and encoder count relationship for shifting movement of the needle bar between the second position and the first position;

FIG. 9 is a graph similar to that of FIG. 6, illustrating the relationship between the position command signal and the encoder count for the prior art electrohydraulic needle bar positioner, disclosed in prior U.S. Pat. No. 4,173,192.

DESCRIPTION OF THE PREFERRED EMBODIMENTS

Figure 1:
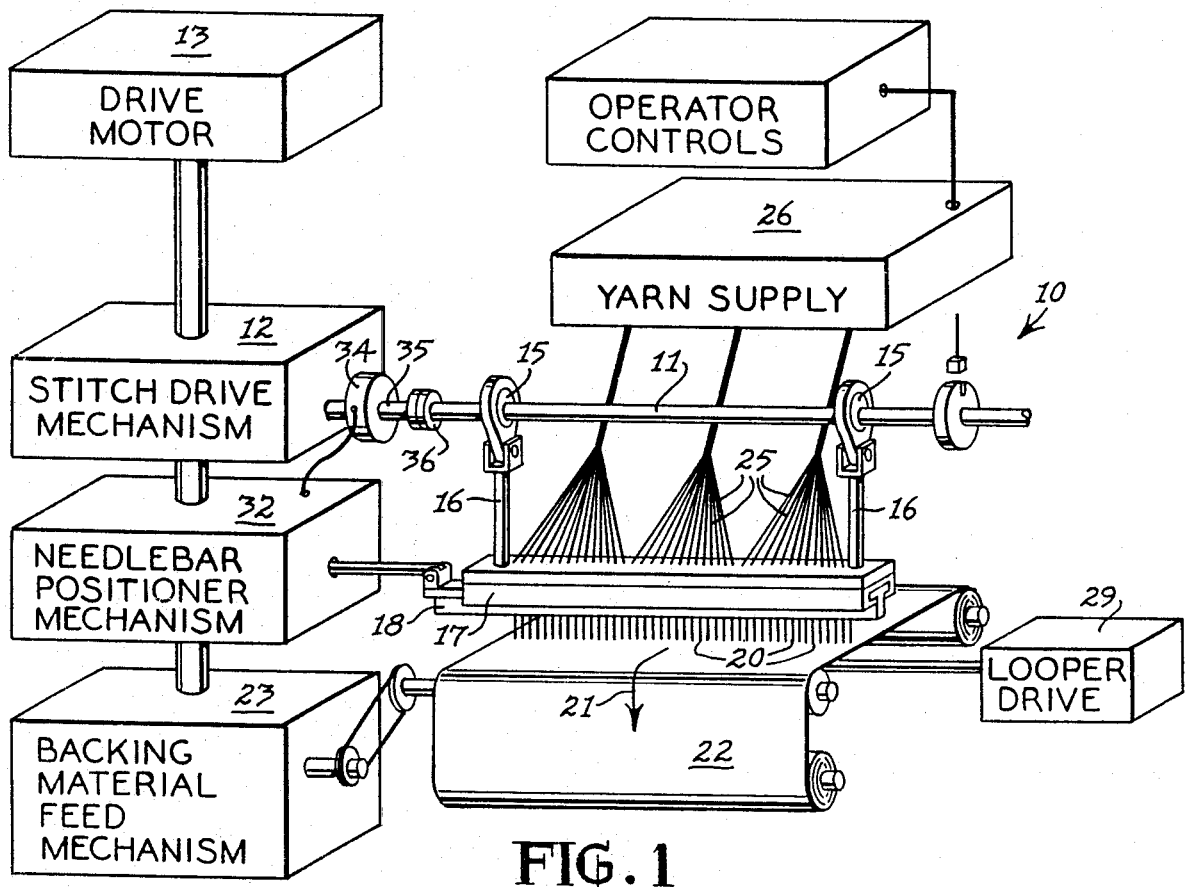
FIG. 1 is a front perspective schematic view of a multiple-needle tufting machine incorporating the electrohydraulic needle bar positioning apparatus of this invention.

Since multiple-needle tufting machines are so well-known in the art, only the basic elements of a typical multiple-needle tufting machine have been disclosed schematically in FIG. 1.

The tufting machine 10 disclosed in FIG. 1 includes a rotary needle shaft or main shaft 11 driven by a stitch drive mechanism 12 from a drive motor 13. Rotary eccentric mechanisms 15 mounted upon the rotary needle shaft 11 are adapted to reciprocably move the vertical push rods 16 for vertically and reciprocably moving the needle bar slide holder 17 and the needle bar 18. The needle bar 18 supports a plurality of uniformly spaced tufting needles 20 in a longitudinal row, or staggered longitudinal rows, extending transversely of the feeding direction 21 of the backing fabric or material 22.

Figures 2, 3, 4:
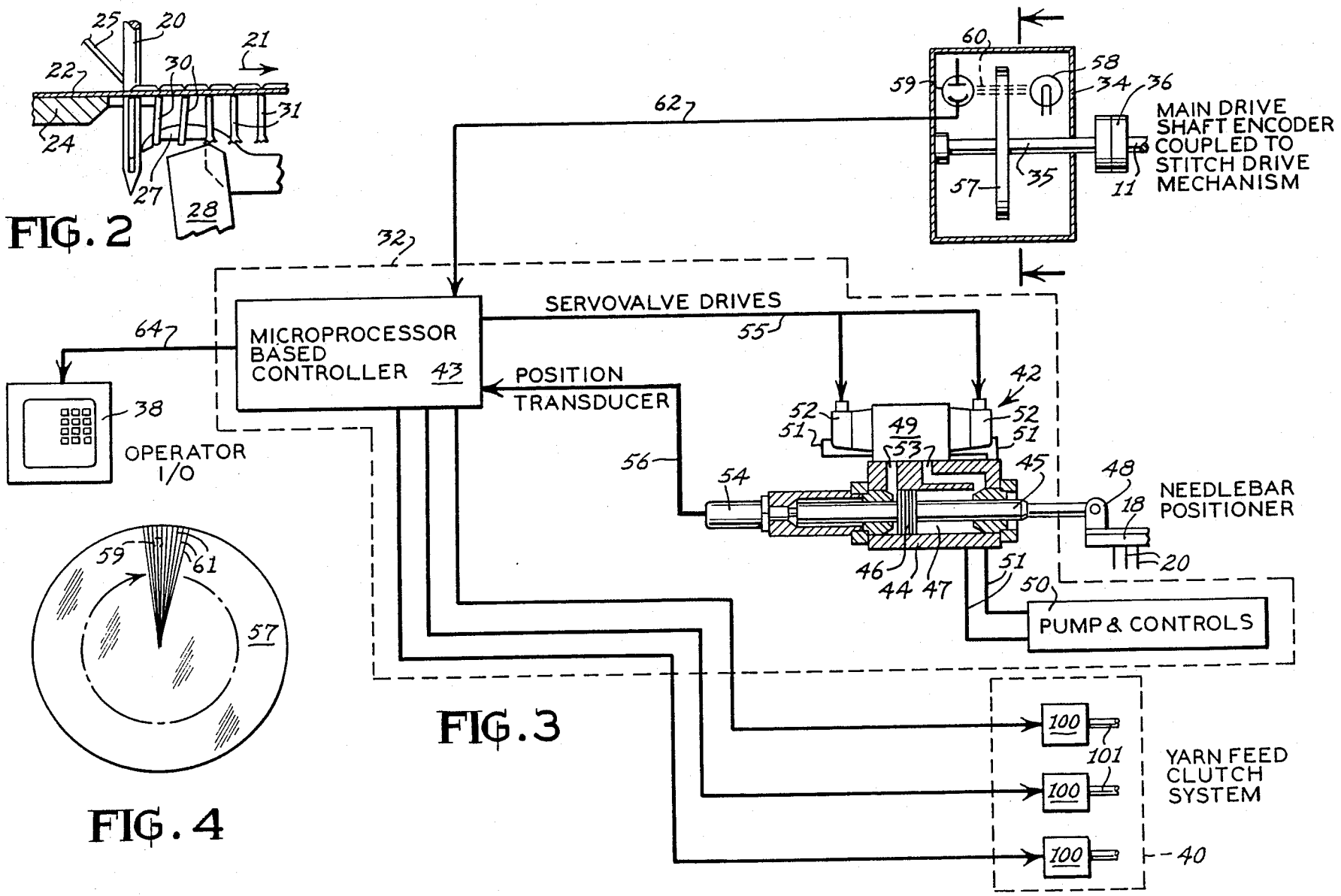
FIG. 2 is an enlarged, fragmentary sectional elevation of a needle and looper forming cut pile stitching in the base fabric of FIG. 1.
FIG. 3 is a schematic block diagram of the needle bar positioning apparatus of FIG. 1.
FIG. 4 an enlarged section taken along the line 4—4 of FIG. 3.

The backing fabric 22 is moved longitudinally through the tufting machine 10 by the backing fabric feed mechanism 23 and across a backing fabric support, including the needle plate 24 (FIG. 2).

Yarns 25 are fed from the yarn supply 26 to the respective needles 20. As each needle 20 carries a yarn 25 through the backing fabric 22, a hook 27 is reciprocably driven by the looper drive 29 to cross each corresponding needle 20 and hold the corresponding yarn 25 to form the loops 30 (FIG. 2). The cut pile tufts 31 are formed by cutting the loops 30 with each knife 28.

Of course, by eliminating the knives 28 and by reversing the direction of, and substituting, loop hooks for the cut pile hooks 27, uncut loops 30 may be formed instead of the cut pile tufts 31, as disclosed in FIG. 2, in a well-known manner.

The needle bar positioning apparatus 32 is designed to laterally or transversely shift the needle bar 18 relative to the needle bar holder 17 a predetermined transverse distance equal to the needle gauge, or a multiple of the needle gauge, and in either transverse direction from its normal central position, relative to the backing fabric 22, and for each stitch of the needles 20.

In order to generate input encoder signals for the needle bar positioning apparatus 32 corresponding to each stitch of the needles 20, an encoder 34 is mounted upon a stub shaft 35, which is operatively connected by coupling 36 to the main shaft or needle shaft 11, so that the stub shaft 35 will have the same RPM s as the needle shaft 11. Since the needle shaft 11 makes one revolution per stitch, the stub shaft 35 will also make one revolution per stitch.

FIG. 3 is a schematic block diagram of the needle bar positioning apparatus 32, the encoder 34, the operator interface device which is an operator I/O (input/output) terminal 38, as well as an optional yarn feed clutch mechanism 40 forming a part of the yarn supply 26. The needle bar positioning apparatus 32 includes a hydraulic actuator 42 adapted to be controlled by the microprocessor based controller 43. The hydraulic actuator 42 is coupled to the needle bar 18 for lateral shifting relative to the tufting machine 10.

The linear hydraulic actuator 42 may be substantially the same as that disclosed in the prior U.S. Pat. No. 4,173,192, and includes an elongated hydraulic cylinder 44 enclosing a linearly reciprocable piston or actuator rod 45 carrying the piston 46 for movement linearly within the hydraulic chamber 47 and connected through coupling 48 to the needle bar 18, as best illustrated in FIG. 3. Hydraulic fluid is supplied to the piston chamber 47 from a pump and pump controls 50 through fluid line 51, servovalves 52, and manifold 49, alternately through the cylinder ports 53 for controlling transverse linear movement of the piston 46 and actuator rod 45, and consequently the needle bar 18.

Attached to the opposite end of the hydraulic cylinder 44 from the needle bar 18 is a feedback transducer 54 adapted to cooperate with the transversely shifting piston rod 45 to produce feedback signals to the microprocessor based controller 43 corresponding to the actual position of the actuator rod 45 and hence the needle bar 18. The particular position feedback transducer 54 used is a "Temposonics" magnetostrictive-type position transducer, Part No. DCTM-402-1. Although the transducer mechanism disclosed in the prior U.S Pat. No. 4,173,192 may be utilized, nevertheless, the above-described "Temposonics" position transducer improves the linearity performance of the feedback transducer 54.

Although the servovalve disclosed in the prior U.S. Pat. No. 4,173,192 may be utilized, nevertheless, it is preferred that two such servovalves be used, as illustrated in FIG. 3 in order to improve the maximum rate of shifting of the actuator or piston rod 45 and the needle bar 18.

The servovalve 52 is connected through electrical bus 55 to the microprocessor controller 43, while the transducer 54 is coupled to the controller 43 through the electrical bus 56.

The encoder 34 utilized in this invention is preferably a quadrature phase incremental encoder with index impulse (DISC. INSTRUMENTS, Part No. 702 FR-1000-IBF-5-LD). As illustrated in FIGS. 3 and 4, the encoder 34 includes a transparent shutter disk 57 fixed upon the stub shaft 35 for rotation between a lamp 58 and a photoelectric cell 59, in order to intercept a light beam 60 passing through the shutter disk 57 adjacent its periphery. As best illustrated in FIG. 4, formed upon the shutter disk 57 are a plurality of uniformly and circumferentially spaced opaque lines 61, each line 61 being adapted to break the light beam 60 as it crosses the light beam 60 during the rotational movement of the disk 57. In a preferred form of the invention, there are 1,000 radial opaque lines 61 impressed upon the disk 60. Thus, each time the disk 57 completes one revolution, the light beam 60 will have been broken 1,000 times to produce 1,000 encoder signals per revolution of the main shaft 11. Each interruption of the light beam 60 is converted by the photocell 59 into an electrical input or encoder signal which is transmitted by the lead 62 to the microprocessor based controller 43.

The operator I/O terminal 38 (FIG. 3) may be a "Fluke, Model 1021" operator terminal, and functions as a means for introducing data into the microprocessor based controller 43 through bus 64, which may be the industry standard "RS232 Serial Communication Line".

Figure 5:
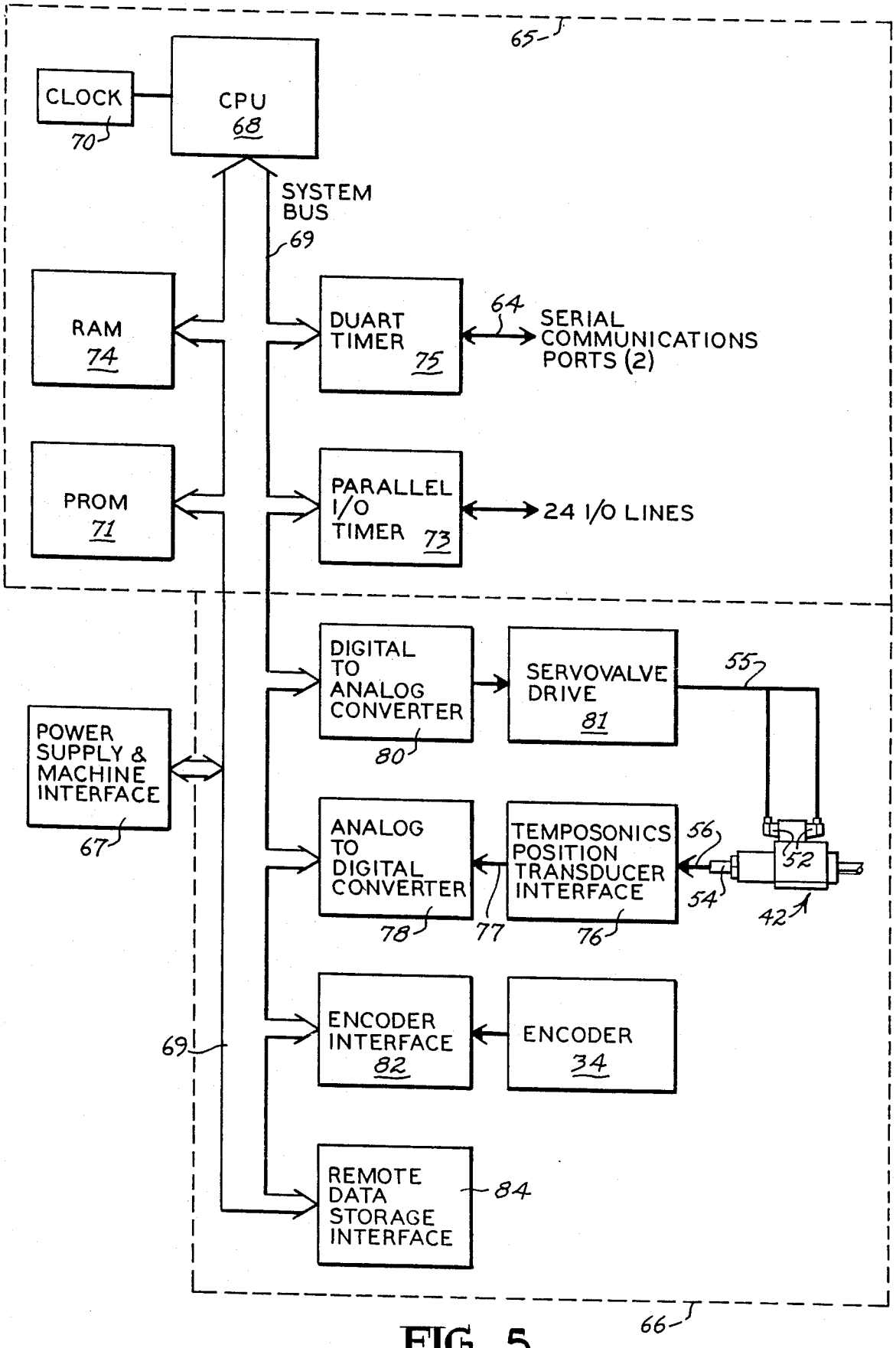
FIG. 5 is a block diagram of the microprocessor based controller disclosed in FIG. 3.

The block diagram of FIG. 5 illustrates the various components of the microprocessor based controller 43. Basically, the controller 43 includes a computer processing unit 65, a signal processing unit 66, and a power supply and machine interface 67. The computer processing unit 65 functions as a computational and logic execution element only. All information utilized by this unit 65 is digitally encoded into 8 bit bytes or 16 bit words. All real world signals are conditioned on the signal processing unit 66 which converts such signals from analog levels into digitally encoded information usable by the computer processing unit 65.

The power supply and machine interface 67 provide appropriate power to the electronic elements within the computer processing unit 65 and the signal processing unit 66, utilizing standard 120 VAC power available as the input. Conditioned power is generated by a Power General (Part No. DC50-2A) power supply. The machine's discrete interfaces are made through commercially available electromechanical relays and optical isolaters.

As disclosed in FIG. 5, the computer processing unit 65 includes a central processing unit (CPU) 68, specifically a Motorola Part No. MC68000, microprocessor integrated circuit. The central processing unit 68 performs all computational and logic operations along with generating the required system bus 69 functions of address, data and control. All devices in the microprocessor based controller 43 are synchronized by the clock 70 which is a crystal oscillator manufactured by Fox (Part No. F1100). The speed of the system clock 70 is 10 megahertz.

The control algorithm or algorithms are stored in the system ROM or PROM (programmable read only memory) 71. The integrated circuits incorporated in the PROM 71 are those of Signetics Corp., Part No. 27C256-15FA.

The parallel I/O controller and timer integrated circuit 73 is preferably Mostek, Part No. MK68230N 10, and provides logic level interface to the system as well as generating critical internal timing markers for the system.

The buffer storage memory RAM (random access memory) 74 is preferably Toshiba Part No. TC5565APL. The RAM 74 serves as the storage location for all dynamic control variables, particularly those which change at very high speed, such as encoder counts and the command and feedback position signals, to be discussed later.

The serial communication bus 64 from the operator I/O terminal 38 communicates with the system bus 69 through the DUART (dual universal asynchronous receiver transmitter) 75, preferably a Motorola integrated circuit, Part No. MC68681.

As illustrated in FIG. 5, the computer processing unit 65 communicates with the signal processing unit 66 through the system bus 69.

As further illustrated in FIG. 5, the feedback transducer 54 is connected through bus 56, transducer interface 76, and bus 77 to the A/D (analog-to-digital) converter 78, which converts the DC feedback voltages into corresponding digital information which is transmitted through the system bus 69 to the computer processing unit 65. The A/D converter 78 may be National Part No. AD574AJD, for processing an analog feedback signal of plus or minus 10 volts D.C. proportional to the actuator position.

The system bus 69 also communicates with the D/A (digital-to-analog) converter 80 for converting the output digital signals or information into a corresponding analog drive signal i the form of a DC voltage, which is then amplified in the servovalve drive circuit 81. The amplified analog drive signal is then transmitted through the bus 55 to energize the servovalve 52 to open the flow of hydraulic fluid to the hydraulic actuator 42 in an amount and direction proportional to the magnitude and polarity of the drive signal. The D/A converter 80 may be a National D to A converter IC, Part No. DAC1209LCJ.

Also connected to the system bus 69 is the encoder interface 82 consisting of the logic circuitry required to count the output pulses from the incremental encoder 34. The encoder interface logic circuitry 82 may be National 74HC193 up/down counters.

Also connected to the system bus 69 is a remote data storage interface 84 serving to provide the system with preprogrammed pattern information. The interface 82 is usually in the form of a plug-in prom, similar in function to that disclosed in FIG. 4 of U.S. Pat. No. 4,173,192. Differently programmed PROMS or interfaces 84 may be used for different patterns to be formed in the backing fabric 22. This interface 84 is provided to prevent external noise or interference from corrupting the system bus 69 and is preferably National 74HCT245 tri-state latches.

Instead of introducing different pattern information through the interface 84, it may be introduced through the operator I/O terminal 38 where such information is stored in the PROM 71. The operator I/O terminal 38 may also be used to enter calibration data information relating to the particular tufting machine 10. The terminal 38 may also be used to display error signals for monitoring and correction, as well as production statistics for a particular machine 10.

FIG. 6 graphically illustrates the algorithm utilized in the microprocessor based controller 43 for controlling the transverse shifting movement of the needle bar actuator 42.

When the machine 10 is in operation, the microprocessor based controller 43 receives continuously encoder signals at the rate of 1,000 per revolution, as illustrated by the X-axis of the graph disclosed in FIG. 6. The encoder signals are read and decoded by the controller 43 and used by the controller 43 to compute the ramped command signal illustrated by the graph in FIG. 6.

Figure 8:
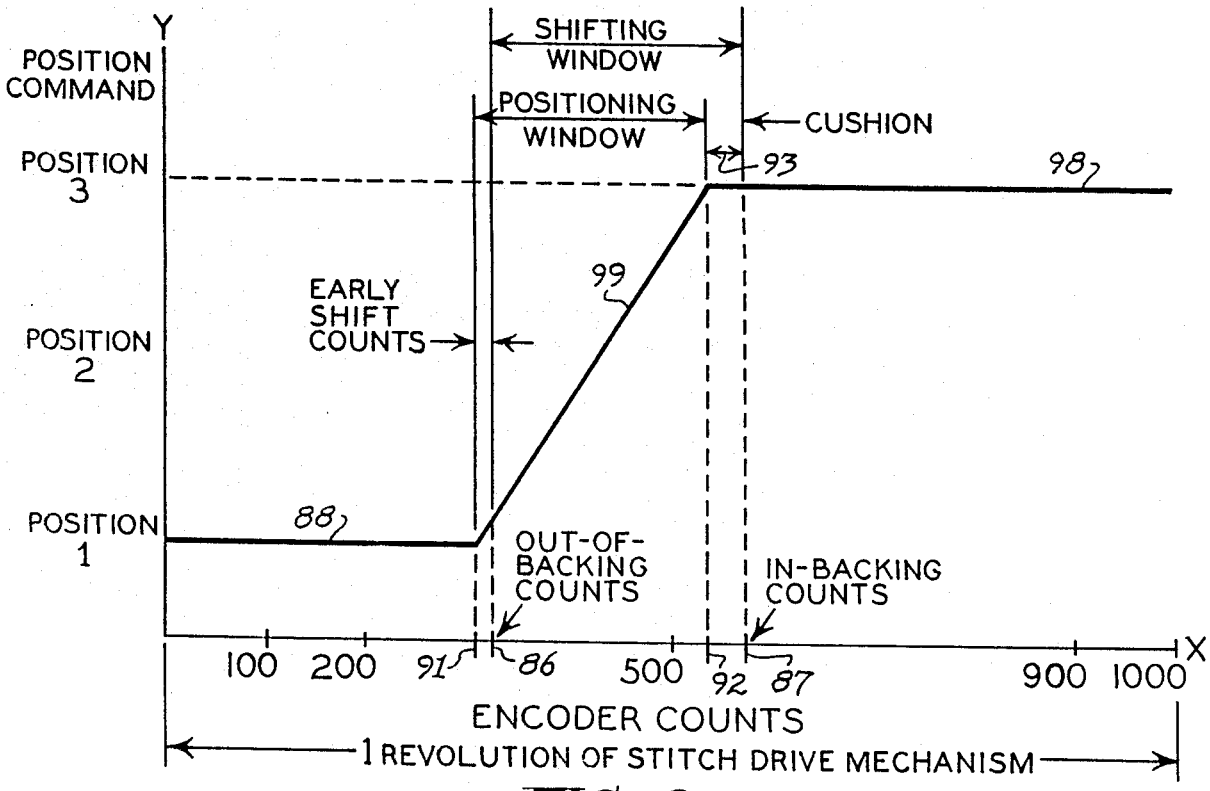
FIG. 8 is a graph similar to that of FIG. 6, illustrating the position command signal and encoder count relationship for shifting movement of the needle bar between a first and a third position, that is through a multiple gauge interval.

The algorithm incorporated in the controller 43 defines a relationship between the encoder counts on the X-axis and certain position command signals on the Y-axis corresponding to desired transverse positions of the needle bar 18, represented by the graphs displayed in FIGS. 6, 7 and 8. The encoder 34 is set so that after a predetermined number of encoder counts, such as at the out-of-backing encoder count 86 having a value, such as 340 counts, the needles 20 have been elevated by the needle bar 18 to a position in which the tips of the needles have just cleared the backing fabric 22. As the encoder 34 continues to count, and reaches the encoder count 87 having a value of, for example, 590 counts, as illustrated in the graph in FIG. 6, the descending needles 22 are just entering the backing fabric 22.

The horizontal line 88 represents the constant value of the digital position command signal when the needle bar 18 is in a transverse stationary position 1 in which the needle bar 18 is not shifting, and preferably when it is in its normal central position. Moreover, the length of the horizontal line 88 corresponds with a number of encoder counts in the stitch cycle in which the needles 20 are penetrating the backing fabric 22, and no drive signal to the servovalve 52 is generated.

The horizontal line 89 represents another constant value of the digital position command signal when the needle bar 18 is in another transverse stationary position 2 in which the needle bar 18 is not shifting, but has been transversely shifted one needle gauge from position 1. Moreover, the length of the horizontal line 89 corresponds with a number of encoder counts in the stitch cycle in which the needles 20 are penetrating the backing fabric 22, and no drive signal to the servovalve 52 is generated.

A linear sloping ramp line 90 connects the two horizontal position lines 88 and 89, preferably at points corresponding to encoder counts 91 and 92, defining a slope of less than 90 deg. The sloping ramp line 90 corresponds to a number or span of encoder counts during the stitch cycle, in which a command signal is generated, which after being compared with a current feedback signal from the feedback transducer 54, will produce a drive signal which will cause the actuator to shift the needle bar 18 from transverse position 1 to transverse position 2. The difference between the initial encoder count 91 of the ramp 90, later referred to as the early shift count, and the final or terminal encoder count 92 of the ramp 90 is referred to as the "Positioning Window" (PW), (FIG. 6).

The difference between the out-of-backing encoder count 86 and the in backing encoder count 87 is referred to as the "Shifting Window" (SW), and represents the number of encoder counts, or the rotary angle of the main shaft 11, during which the needles 20 are elevated and not penetrating the backing fabric 22, and during which the needle bar 18 may be transversely shifted in either direction.

As further illustrated in FIG. 6, the early shift count 91 is represented on the X-axis by a value, such as 310 encoder counts, slightly in advance of the out-of-backing encoder count 86, which is represented by a value, such as 340 counts. When the encoder 34 counts to the early shift count 91, the resulting signal is processed by the signal processing unit 66 and transmitted to the CPU 68 to generate the position command signals represented by the ramp line 90 disclosed in FIG. 6, until the encoder count 92 is reached and the constant command signal represented by the horizontal line 89 is generated to de-energize the servovalve 52.

It will be noted in FIG. 6, that the encoder count 92 having a value, such as 540 counts, occurs a predetermined number of counts in advance of the in-backing encoder count 87 having a value, such as 590 encoder counts, in order to define the cushion interval 93, having a value, in this instance, of 50 encoder counts.

Because of the substantial speeds, such as 1,250 RPM of the main shaft 11 of the tufting machine 10, and because of the inertia of the hardware, such as the servovalve 52 and the transversely moving parts of the machine, including the needle bar 18 and the actuator rod 48, the early shift count 91 and the cushion interval 93 are provided for in the algorithm of the microprocessor controller 43.

Thus, as illustrated in FIG. 6, the initial position command signal generated at the early shift count 91, slightly in advance of the out-of-backing encoder count 86, commences the sequence of digital operations within the controller 43 which subsequently commences the shifting of the actuator bar 45, after the inertia of the transversely moving hardware has been overcome. Thus, by the time the actuator rod 45 and the needle bar 18 actually commence their transverse shifting movement at the beginning of the "Shifting Window" (FIG. 6), the needles 20 will have risen out of the backing material 22 at, or just after, the encoder count 86.

Also, because of the inertia of the transversely moving hardware, including the needle bar 18 and the actuator rod 45, the position command signal is terminated at the encoder count 92 to permit the transversely moving hardware to coast or slow down before it stops just prior to the introduction of the descending needles 20 into the backing material 22 at, or just prior to, the encoder count 87.

Although the generation of position command signals at the early shift count 91, and for the "Shifting Window" (SW) are dependent upon the angular position of the main shaft 11, or the number of encoder counts, the cushion interval 93 is solely time dependent. Stated another way, regardless of the rotary speed of the main drive shaft 11, the values of the encoder counts in the graph of FIG. 6 remain the same, except for the length of the cushion interval 93. Although the position command signals for positions 1 and 2 will remain the same, the slope of the ramp 90 will vary with the length of the cushion interval 93. When the cushion interval 93 increases, the slope of the ramp 90 will increase. Since the cushion interval 93 is time dependent, the length of the cushion interval 93 will remain constant only as long as the speed of the main drive shaft 11 is constant. When the speed of the main drive shaft 11 is low, for example 200 RPM, the cushion interval 93 will be substantially shorter, that is, there will be less of a difference between encoder counts 92 and 87, because it is not necessary to provide much of a cushion when the machine is operating at lower speeds. Moreover, the slope of the ramp command 90 will decrease. On the other hand, at substantially higher speeds, the length of the cushion interval 93, that is the number of encoder counts, will increase proportionally to the machine speed, or speed of the main shaft 11, while the slope of the ramp command increases.

The following definitions and relationships are incorporated in the algorithm programmed into the microprocessor based controller 43.

| ELEMENT | UNITS |
|---|---|
| POSITIONING WINDOW (PW)- | encoder counts |
| IN-BACKING COUNT (IB)- | encoder counts |
| OUT-OF-BACKING COUNT (OB) - | encoder counts |
| MACHINE SPEED (V) - | encoder counts milliseconds |
| NEXT STEP OR POSITION (NP) (e.g. POSITION 2) - | position command counts (Y-axis) |
| PREVIOUS STEP OR POSITION (PP) (e.g. POSITION 1) - | position command counts (Y-axis) |
| RAMP COMMAND (RC) - | position command counts |
| DELTA ENCODER POSITION (DELTA EP) - | encoder counts |
| RAMP SLOPE (RS) - | position command counts/encoder counts |
| CUSHION INTERVAL (CI) - | milliseconds |
| CURRENT ENCODER POSITION (CURRENT EP) - | encoder counts |
| EARLY SHIFT COUNTS (ES) - | encoder counts |

COMPUTATIONS $$\text{POSITIONING WINDOW (PW)} = [IB - ES] - [V \times CI]$$

$$\text{RAMP SLOPE (RS)} = \frac{NP - PP}{PW}$$

The above computations are executed by the microprocessor based controller 43 once for each revolution of the main shaft 11, and prior to the early shift count (ES).

At each update of the controller 43, that is 2000 times per second, and independently of the main shaft RPM's or machine speed (V), the following equations are computed:

DELTA ENCODER POSITION (DELTA EP)=CURRENT EP−ES RAMP COMMAND (RC)=PP+(DELTA EP×RS)

The algorithm incorporating the above relationships is programmed into the software and is resident in the system ROM or PROM 71. The actual position commands or pattern information are stored on PROMS, such as the plug-in PROM or interface 84 (FIG. 5), similar to the PROM disclosed in the prior U.S. Pat. No. 4,173,192, or are entered as data through the operator I/O terminal 38.

It will be noted in FIG. 6 that the interval between the position command signals for positions 1 and 2 must be commensurate with the needle gauge since the needle bar 18 must be stopped in a transverse position precisely so that each needle 20 may cooperate with its corresponding looper or hook 27 and/or knife 28, (FIG. 2).

FIG. 7 is a graph similar to FIG. 6, but illustrating graphically the relationships between the position command signals and the encoder counts for the reverse movement of the actuator 42 and the needle bar 18, that is where the needle bar 18 is being moved from position 2 back to position 1. The linear ramp command 95 is the reverse or mirror image of the ramp command 90 of FIG. 6. Here again, the early shift count 91 is in advance of the out-of-backing encoder count 86, and the termination of the command signal at the end of the positioning window at the encoder count 92 is also in advance of the in-backing encoder count 87 to provide the cushion interval 93 in advance of the in-backing encoder count 87.

FIG. 8 is a graphical illustration similar to that in FIG. 6 of the relationships between the position command signals and the encoder counts utilized to shift the needle bar from position 1 to position 3 for each revolution of the main drive shaft 11. It will be noted in FIG. 8 that the differences in the critical encoder counts 91, 86, 92, and 87 are identical to those in FIG. 1, since the needles 20 rise out of the backing fabric 22 and enter the backing fabric 22 during the same angular intervals of each revolution of the main shaft 11, while the needle bar 18 must be shifted twice as far, that is through an interval of two needle gauges. The position command signals for Position 1 are represented by the horizontal line 88, while the position command signals for Position 3 are represented by the horizontal line 98. The ramp command signals are represented by the steep sloping line 99.

FIG. 10 is a graph of the position command signals and encoder intervals for each revolution of the needle bar utilized in the prior art electrohydraulic needle bar positioning apparatus disclosed in the prior U.S. Pat. No. 4,173,192.

In FIG. 10, the command signal representations of positions 1 and 2 corresponding to the transverse positions of the needle bar are the same as those disclosed in FIG. 6. However, since there was only one input encoder signal per revolution of the main drive shaft in the apparatus disclosed in the prior U.S. Pat. No. 4,173,192, the position command signal was generated instantaneously directing the hydraulic actuator to move at maximum speed independently of the speed of the main shaft 11 of the tufting machine during the "Shifting Window".

Accordingly, such operation caused excessive shock loads to the machinery because of the abrupt stopping and starting and change of direction of the actuator and the needle bar 18. Accordingly, such abrupt signals and changes in direction of the hardware limited the machine life as well as causing considerable noise in the operation of the tufting machine.

As disclosed in FIG. 10, the slope of the ramp line 190 is 90 deg., and therefore, produces an infinite velocity command signal.

The above description of the units and relationships, and their graphic representations in FIGS. 6–8, as well as the remaining description of the invention, and the disclosures in tee prior U.S. Pat. No. 4,173,192, are sufficient to enable one ordinarily skilled in the digital computer art with specific knowledge of microprocessors and the programming thereof, to reproduce the above described apparatus.

While the machine 10 is in operation, the rotation of the main shaft 11 produces sequential encoder signals at uniform intervals, such as 1,000 such encoder signals per shaft revolution. These encoder signals are received in the microprocessor controller 43, decoded and read. When the next encoder counts after count 91 are entered into the system, digital position ramp command signals are generated corresponding to the values defined by sloping linear ramp command line 90. The position command signals are then compared with the current feedback signals from the feedback transducer 54, corresponding to the actual position of the actuator rod 45, in a manner well known in the art of computer science in order to produce a digital drive signal. The drive signal is then multiplied by a constant value, as illustrated in the following equation:

DIGITAL DRIVE SIGNAL (D)=K [DIGITAL POSITION COMMAND SIGNAL (C)−DIGITAL FEEDBACK SIGNAL (F)]

or $$D=K\,(C-F)$$

where K=a constant

The conditioned digital drive signal (D) is then compared with maximum limit levels and transmitted through the D/A converter 80 to convert the digital drive signal into an analog drive signal. The analog drive signal is then amplified in the drive circuit 81, and transmitted to the servovalve 52 to immediately actuate the valve 52 to transmit the flow of hydraulic fluid to one side of the piston 42 in order to drive the actuator rod 45 in the direction dictated by the values represented in either FIGS. 6 7, or 8, to the desired next transverse position of the needle bar 18. The initial and terminal portions of the movement of the actuator rod 45 are gradual. However, the major intermediate portion of the actuator rod movement is substantially uniform throughout its linear travel at low speeds, e.g. 350 RPM, creating a smooth transition for the needle bar 18 with a minimum of noise and wear upon the actuator and the machine parts At higher speeds, e.g. 1250 RPM, the drive signal voltage will gradually increase to about the mid-point of the needle bar travel and then gradually decrease because of the inertia of the moving machine elements or hardware.

When the encoder 34 is counting in the encoder count intervals between 0 and the early shift count 91 (Position 1) or between the terminal count 92 and 100 (Position 2), the same constant command signal is generated corresponding to position 1 or position 2. Such constant command signal is compared with an equal constant feedback signal from the transducer 54 to produce a zero drive signal, so that the needle bar 18 remains in its corresponding transverse position 1 or 2.

However, whenever, the encoder count is counting in the "Position Window" interval, the position command signals or ramp commands increase linearly (in FIGS. 6 and 8). These positive command signals are then compared with feedback signals changing with the transverse positions of the actuator rod 45, but of lesser value than the corresponding position command signals to produce the output signals, which when multiplied by the constant K generates a drive signal which ultimately causes the actuator rod 45 and needle bar 18 to shift transversely between the programmed positions 1-2 (FIG. 6), 2-1 (FIG. 7), 1-3 (FIG. 8), or other positions determined by the programmed pattern information in the PROM 71 and the interface 84.

The microprocessor based controller 43 may operate to produce signals responsive to the machine speed for actuating the yarn feed clutch system 40. At the appropriate time the clutches 100 are disengaged from the yarn feed shafts 101 to produce slack in the yarn 25 fed to the needles 20 as the needle bar 18 is moving transversely. The apparatus may be utilized without the yarn feed clutch system 40, in which event the extra yarn required by the transversely moving needles will be obtained by backrobbing the previously formed loops, in a well known manner.

Where it is desired to change the patterns of yarn formed in the backing fabric 22 by changing the transverse movements of the needle bar 18, different pattern information may be introduced into the ROM or PROM 71 by substituting other plug-in PROMS in the storage interface 84 with different pattern information permanently impressed thereon, such as disclosed in the prior U.S. Pat. No. 4,173,192, or such information may be introduced through the operator I/O terminal 38.

What is claimed is:

1. In a tufting machine having a backing fabric support, means for feeding backing fabric longitudinally through the machine, a needle bar supporting a plurality of needles transversely of said machine, yarn supply means for feeding yarns to said needles, and means for reciprocating said needle bar at a predetermined needle stitch rate to drive said needles into and out of the backing fabric upon the backing fabric support, a positioning apparatus for shifting transversely the needle positions relative to the backing fabric, comprising:

(a) a reciprocably movable, hydraulically driven actuator for transversely shifting a needle bar to different needle positions, (b) pressurized hydraulic fluid supply means for said actuator, (c) servovalve means for controlling the flow of hydraulic fluid to said actuator, (d) computer control means including a computer processor and a signal processor, and having input means and output means, (e) said computer processor comprising programmed digital pattern information corresponding to a stitch pattern pre-determining the relative transverse position of said needle bar for each longitudinal needle stitch position, (f) stitch encoder means communicating with said input means for producing a plurality of encoder counts for each needle stitch cycle in said computer processor, (g) means in said computer processor for utilizing said programmed information to produce a plurality of position command signals corresponding to said encoder counts, each position command signal corresponding to a transverse position of said actuator, (h) means in said computer processor utilizing said programmed information to cause said position command signal to vary linearly with said encoder counts during a predetermined positioning window encoder count interval, (i) electrical feedback means responsive to the actual position of said actuator producing corresponding feedback signals, (j) means in said computer processor for comparing each position command signal with a corresponding feedback signal to produce a corresponding drive signal, (k) means for transmitting each drive signal to said servovalve means to control the flow of hydraulic fluid to said actuator to position said needle bar in a transverse position corresponding to each corresponding drive signal, and (l) timing means responsive to said encoder counts permitting said actuator to shift transversely only when the needles in said needle bar are above the backing fabric.

2. The invention according to claim 1 in which said timing means comprises a shifting window encoder count interval between an out-of-backing encoder count corresponding to a vertical needle bar position in which the needles rise out of tee backing fabric and an in-backing encoder count corresponding to a vertical needle bar position in which the needles commence to penetrate the backing fabric, for each needle stitch cycle, said actuator transversely shifting said needle bar only within said shifting window encoder count interval.

3. The invention according to claim 2 in which the initial encoder count of said positioning window interval is an early shift count signal occurring in advance of said out of backing encoder count, to commence a change in said position command signal and to initially produce a drive signal.

4. The invention according to claim 2 in which said programmed information further comprises a cushion encoder count interval between the termination count of said positioning window interval and said in-backing encoder count to produce a constant position command signal and to terminate said drive signal prior to the penetration of the needles into the backing fabric.

5. The invention according to claim 4 in which the length of said cushion interval is directly proportional to the needle stitch rate.

6. The invention according to claim 1 in which said feedback means comprises a feedback transducer operatively connected to said actuator for producing feedback signals corresponding to the actual position of said actuator, analog-to-digital converter means connecting said transducer to said computer processor whereby said feedback signals are converted to corresponding digital feedback information, said position command signals comprising digital command information, means for comparing said digital command information with said digital feedback information to produce output error digital information, and digital-to-analog converter means, converting said error signal digital information into an analog drive signal.

7. The invention according to claim 1 in which the means for reciprocating said needle bar comprises a rotary needle shaft, said encoder sensor means comprising means for generating a plurality of electrical input signals for each revolution of said needle shaft.

8. The invention according to claim 1 in which said actuator comprises a linearly movable actuator rod and a hydraulically driven piston for moving said rod, said valve means comprising means for selectively directing the flow of hydraulic fluid to the opposite sides of said piston.

9. The invention according to claim 1 in which the difference between the position command signals produced at the extremities of said positioning window interval is commensurate with the needle gauge of said needles, or multiples of said needle gauges.

10. The invention according to claim 1 in which said programmed information in said computer processor comprises the equation:

$$PW=[IB-ES]-[V\times CI]$$

Where PW=positioning window interval in encoder counts; IB=in backing encoder count; ES=early shift count in encoder counts; V=machine speed or main rotary shaft speed in encoder counts/milliseconds; and CI=cushion interval in milliseconds.

11. The invention according to claim 1 in which said programmed information in said computer processor comprises equation:

$$RS=\frac{(NP-PP)}{PW}$$

Where RS=Ramp slope in position command counts/encoder counts; NP=next position of hydraulic actuator in position command counts; PP=previous position of hydraulic actuator in position command counts; PW=positioning window in encoder counts.

12. The invention according to claim 1 in which said programmed information in said computer processor comprises the equation:

$$\text{Delta EP}=\text{Current EP}-\text{ES}$$

Where Delta EP=Delta (or change in) encoder position in encoder counts; Current EP=current encoder position in encoder counts; and ES=early shift count in encoder counts.

13. The invention according to claim 1 in which said programmed information in said computer processor comprises the equation:

$$RC=PP+(\text{Delta EP}\times RS)$$

Where RC=ramp command in position command counts; PP=previous position in position command counts; Delta EP=Delta (change in) encoder position in encoder counts; and RS=ramp slope in position command counts/encoder counts.

* * * * *